US011970927B1

(12) United States Patent
Aborshaid et al.

(10) Patent No.: US 11,970,927 B1
(45) Date of Patent: Apr. 30, 2024

(54) BOTTOMHOLE SWEETENING OF SOUR GAS WELLS

(71) Applicant: Saudi Arabian Oil Company, Dhahran (SA)

(72) Inventors: Hussain A. Aborshaid, Al Khobar (SA); Hatim S. AlQasim, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/158,584

(22) Filed: Jan. 24, 2023

(51) Int. Cl.
*E21B 33/122* (2006.01)
*E21B 34/08* (2006.01)
*E21B 43/16* (2006.01)

(52) U.S. Cl.
CPC ..... *E21B 43/16* (2013.01); *E21B 33/122* (2013.01); *E21B 34/08* (2013.01)

(58) Field of Classification Search
CPC ..... E21B 33/122; E21B 34/08; E21B 34/10; E21B 43/16
See application file for complete search history.

(56) References Cited

U.S. PATENT DOCUMENTS 5,211,242 A * 5/1993 Coleman ..... E21B 43/121 166/107
5,377,764 A * 1/1995 Jennings, Jr. ..... E21B 43/164 166/372
7,128,150 B2 * 10/2006 Thomas ..... E21B 43/162 166/266
7,533,726 B2 * 5/2009 Gaskill ..... E21B 43/168 166/371
8,312,924 B2 * 11/2012 Smith ..... E21B 43/2607 166/57
10,612,350 B2 * 4/2020 Steele ..... E21B 34/10
2010/0108315 A1 * 5/2010 Stevens ..... C09K 8/52 166/268
2018/0193769 A1 * 7/2018 Ayres ..... E21B 43/40

FOREIGN PATENT DOCUMENTS

WO WO-0066882 A1 * 11/2000 ..... C09K 8/58

OTHER PUBLICATIONS

Barsoum et al., "Diluting Acid Gases With Sweet Gases in Gas Lift Systems: Assessment, Challenges, and Recommendations," SPE 95714, Paper presented at the SPE Annual Technical Conference and Exhibition, Dallas, Texas, Oct. 2005, 12 pages.

(Continued)

*Primary Examiner* — Matthew R Buck
(74) *Attorney, Agent, or Firm* — Fish & Richardson P.C.

(57) ABSTRACT

A packer couples a first tubing and a second tubing while sealing against a wall of a wellbore formed in a subterranean formation. A first hydrocarbon stream is flowed across the packer from the surface through the first tubing to a downhole location. The first hydrocarbon stream has a hydrogen sulfide content that is less than a hydrogen sulfide content of downhole fluids present in the subterranean formation. A second hydrocarbon stream is flowed across the packer from the downhole location through the second tubing to the surface.

18 Claims, 5 Drawing Sheets

(56) References Cited

OTHER PUBLICATIONS

Guo et al., "Production Enhancement in Deep Sour Gas Field: A Case Study in China," SPE-202012-MS, Paper presented at the SPE Russian Petroleum Technology Conference, Virtual, Oct. 2020, 12 pages.
Mubashir et al., "Sour Gas Well Testing Challenges-A Successful Case Study," SPE-197482-MS, Paper presented at the Abu Dhabi International Petroleum Exhibition & Conference, Abu Dhabi, UAE, Nov. 2019, 17 pages.
Sturman et al., "Control of Hydrogen Sulfide in Oil and Gas Wells With Nitrite Injection," SPE 56772, Paper presented at the SPE Annual Technical Conference and Exhibition, Houston, Texas, Oct. 1999, 7 pages.
Wilhelm et al., "Selection of Materials for Sour Service in Petroleum Production," J Pet Technol, Oct. 1986, 38:1051-1061, 11 pages.

* cited by examiner

100B

100C

200A

200B

BOTTOMHOLE SWEETENING OF SOUR GAS WELLS

TECHNICAL FIELD

This disclosure relates to production from sour gas wells.

BACKGROUND

Hydrocarbons extracted from a reservoir can contain various impurities. Hydrocarbons that are contaminated with significant amounts of sulfur compounds, such as hydrogen sulfide, is considered sour, while hydrocarbons that are contaminated with little or negligible amounts of sulfur compounds is considered sweet. Hydrogen sulfide, in particular, is highly poisonous, corrosive, and flammable. Therefore, the presence and handling of hydrogen sulfide is not only an operational concern (with respect to equipment and piping corrosion) but also a safety concern. In some cases, hydrocarbon refining processes can include processes that remove such impurities from raw hydrocarbons, for example, before the hydrocarbons are used or transformed into other products.

SUMMARY

This disclosure describes technologies relating to bottomhole sweetening of sour gas wells for producing hydrocarbons from such sour gas wells. Certain aspects of the subject matter described can be implemented as a method. A packer couples a first tubing and a second tubing while sealing against a wall of a wellbore formed in a subterranean formation, such that fluid flow across the packer in a first direction is restricted to flowing through the first tubing and fluid flow across the packer in a second direction different from the first direction is restricted to flowing through the second tubing. A first hydrocarbon stream is flowed across the packer from a surface location through the first tubing to a downhole location within the wellbore. The first hydrocarbon stream has a hydrogen sulfide content that is less than a hydrogen sulfide content of downhole fluids present in the subterranean formation. A second hydrocarbon stream is flowed across the packer from the downhole location through the second tubing to the surface location.

This, and other aspects, can include one or more of the following features. The first tubing and the second tubing can be configured to prevent fluid from flowing from the first tubing to the second tubing and from the second tubing to the first tubing. The packer can include a first port and a second port. The first tubing can be coupled to the first port. The second tubing can be coupled to the second port. Prior to flowing the first hydrocarbon stream across the packer from the surface location through the first tubing to the downhole location within the wellbore, a drilling rig positioned at the surface location can drill into the subterranean formation to form the wellbore in the subterranean formation. Prior to flowing the first hydrocarbon stream across the packer from the surface location through the first tubing to the downhole location within the wellbore, the drilling rig can place the first tubing, the second tubing, and the packer within the wellbore. Sweet gas can be produced from a second wellbore. At least a portion of the first hydrocarbon stream can be sourced from the sweet gas from the second wellbore. At least a portion of the first hydrocarbon stream can be sourced from a sweet gas sales pipeline. The second hydrocarbon stream can be flowed across the packer from the downhole location through the second tubing to the surface location independent of a compressor. The second tubing can include a valve. The valve can be configured to be closed while the first hydrocarbon stream is flowed through the first tubing to the downhole location. The valve can be configured to be opened after the first hydrocarbon stream has mixed with downhole fluids present in the subterranean formation to allow the second hydrocarbon stream to flow through the second tubing to the surface location. The hydrogen sulfide content of the second hydrocarbon stream can be in a range of from 1 part per million (ppm) to 100,000 ppm.

Certain aspects of the subject matter described can be implemented as a method. A first tubing is coupled to a packer. The first tubing permits fluid flow across the packer in a first direction. The packer seals against a wall of a sour gas well. The sour gas well includes sour gas. A second tubing is coupled to the packer. The second tubing permits fluid flow across the packer in a second direction that is different from the first direction. The second tubing is fluidically isolated from the first tubing. Sweet gas is injected through the first tubing from a surface location across the packer to a downhole location within the sour gas well. The sweet gas mixes with the sour gas to form a diluted gas. The diluted gas is produced through the second tubing from the downhole location across the packer to the surface location.

This, and other aspects, can include one or more of the following features. The first tubing and the second tubing can be configured to prevent fluid from flowing from the first tubing to the second tubing and from the second tubing to the first tubing. The packer can include a first port. The packer can include a second port. Coupling the first tubing to the packer can include coupling the first tubing to the first port. Coupling the second tubing to the packer can include coupling the second tubing to the second port. Prior to injecting sweet gas through the first tubing across the packer from the surface location to the downhole location within the sour gas well, a drilling rig positioned at the surface location can drill into a subterranean formation to form a wellbore of the sour gas well. Prior to injecting sweet gas through the first tubing across the packer from the surface location to the downhole location within the sour gas well, the drilling rig can place the first tubing, the second tubing, and the packer within the wellbore. Sweet gas can be produced from an offset well located apart from the sour gas well. The sweet gas produced from the offset well can be injected into the sour gas well through the first tubing. At least a portion of the sweet gas that is injected into the sour gas well can be sourced from a sweet gas sales pipeline. The diluted gas can be flowed across the packer from the downhole location through the second tubing to the surface location independent of a compressor. The second tubing can include a valve. The valve can be configured to be closed while the sweet gas is flowed through the first tubing to the downhole location. The valve can be configured to be opened after the sweet gas has mixed with the sour gas to form the diluted gas to allow the diluted gas to flow through the second tubing to the surface location.

Certain aspects of the subject matter described can be implemented as a system. The system includes a wellbore, a dilution stream, a first tubing, a second tubing, and a packer. The wellbore is formed in a subterranean formation that includes a downhole fluid having a first hydrogen sulfide content. The dilution stream includes a hydrocarbon. The dilution stream has a second hydrogen sulfide content that is less than the first hydrogen sulfide content of the downhole fluid. The first tubing extends from a surface location to a downhole location within the wellbore. The first tubing is configured to flow the dilution stream from the surface location into the wellbore, such that the dilution stream mixes with the downhole fluid. The second tubing extends from the surface location to the downhole location. The second tubing is configured to flow a production stream from the wellbore to the surface location. The production stream has a third hydrogen sulfide content that is intermediate of the first hydrogen sulfide content of the downhole fluid and the second hydrogen sulfide content of the dilution stream prior to mixing of the dilution stream and the downhole fluid. The packer is positioned within the wellbore. The packer is coupled to the first tubing and to the second tubing. An outer surface of the packer is sealed against a wall of the wellbore, such that fluid flow across the packer in a first direction is restricted to flowing through the first tubing and fluid flow across the packer in a second direction different from the first direction is restricted to flowing through the second tubing.

This, and other aspects, can include one or more of the following features.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes production of hydrocarbons from sour gas wells. The presence of certain acidic compounds, such as hydrogen sulfide, can introduce operational and safety issues due to their corrosive properties and toxicity. A dual ported packer is coupled to a first tubing and a second tubing. Dilution gas is injected into the sour gas well via the first tubing to dilute a sulfur content of the sour gas present in the well. A sufficient amount of dilution gas can be injected into the sour gas well to dilute the downhole fluids to a point (for example, a hydrogen sulfide concentration) at which the downhole fluids can be safely produced from the well free of the risk of damaging downhole and/or surface equipment. After the dilution gas has mixed with the sour gas in the well to form a diluted gas, the diluted gas is produced via the second tubing.

The subject matter described in this disclosure can be implemented in particular implementations, so as to realize one or more of the following advantages. The systems and methods described can be implemented to dilute sulfur content (for example, hydrogen sulfide content) of downhole fluids by injecting sweet gas into the subterranean formation prior to producing hydrocarbons from the formation. The systems and methods described can be implemented to safely and efficiently produce hydrocarbons from sour gas wells while simultaneously mitigating and/or eliminating the negative impacts of the presence of hydrogen sulfide in sour gas on downhole and surface equipment. The systems and methods described can extend the operational life of sour gas wells and reduce maintenance downtime and costs. The systems and methods described can be implemented to reduce bottomhole pressure and increase drawdown in sour gas wells, which can improve productivity. The systems and methods described can be implemented to remedy liquid loading issues in gas wells, for example, by injection of gas into the well to reduce hydrostatic pressure in the gas well. The systems and methods described can be more cost effective and simpler to install in comparison to conventional downhole gas sweetening processes. In some cases, the systems and methods described can be implemented to produce sweet gas from sour gas wells independent of surface injection systems, such as compressors. The systems and methods described can be implemented to reduce rupture exposure radius (RER) of producing gas wells. RER is a safety measurement for determining a safe operating area around gas wells. Reducing RER by implementing the systems and methods described can allow for production from sour gas wells in a safe and reliable manner in areas that otherwise would be deemed too risky for production.

Figure 1A:
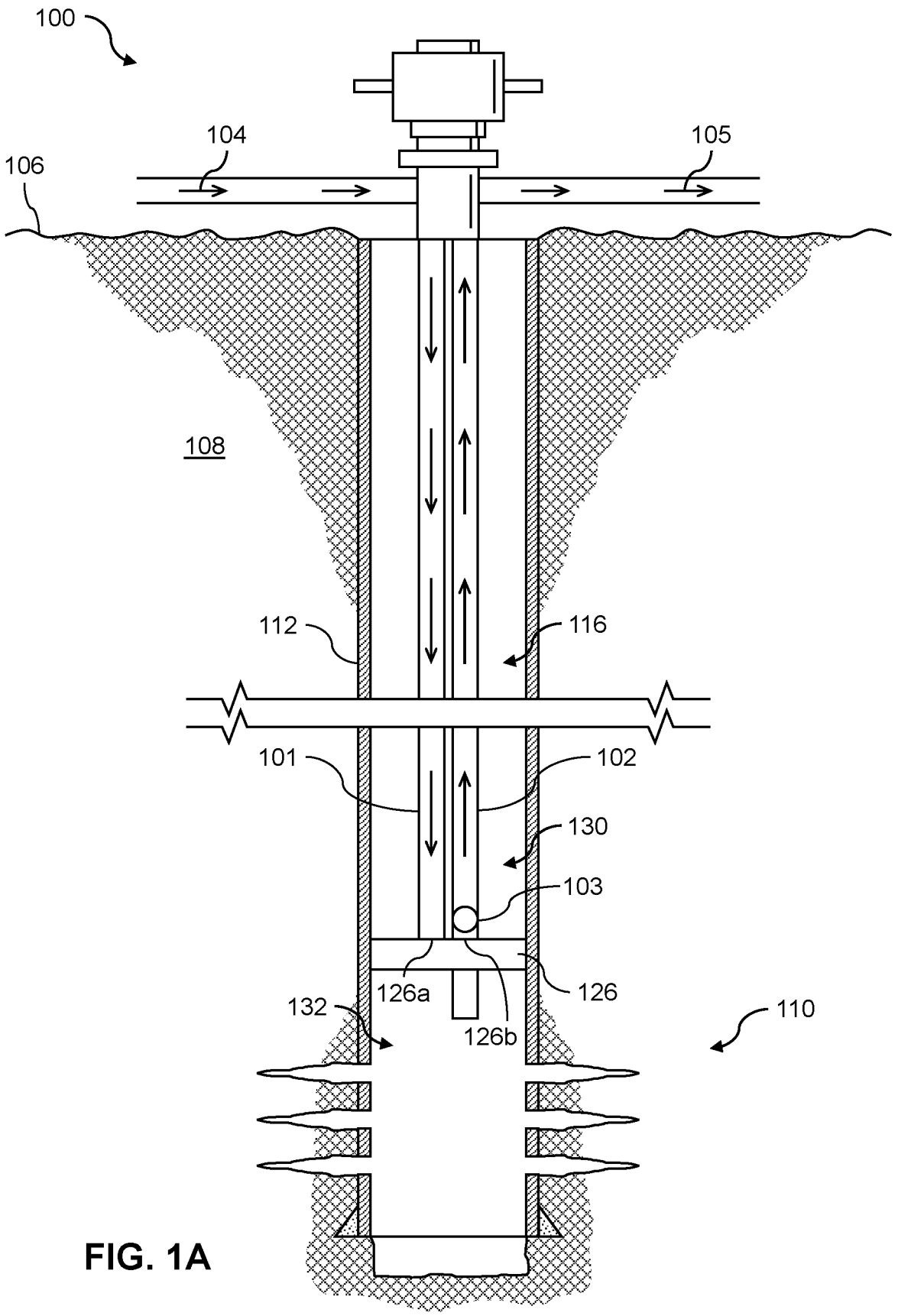
FIG. 1A is a schematic diagram of an example well.

FIG. 1A depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1A) and, in some implementations, additionally or alternatively allows fluids to be placed in the Earth 108. For example, the well 100 can include a first tubing 101 for placing fluid into the Earth 108 (for example, into the subterranean zone 110). For example, the well 100 can include a second tubing 102 (for example, a production tubing) for producing fluid from the subterranean zone 110 to the surface 106. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1A, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1A shows well 100 being produced with a Christmas tree attached to the wellhead. The Christmas tree includes valves used to regulate flow into or out of the well 100. In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size.

A packer 126 integrated or provided separately with a downhole system divides the well 100 into an uphole zone 130 above the packer 126 and a downhole zone 132 below the packer 126. The wall of the well 100 includes the interior wall of the casing 112 in portions of the wellbore having the casing 112, and includes the open hole wellbore wall in uncased portions of the well 100. Thus, the packer 126 is configured to seal against the wall of the wellbore, for example, against the interior wall of the casing 112 in the cased portions of the well 100 or against the interior wall of the wellbore in the uncased, open hole portions of the well 100. The packer 126 can form a gas- and liquid-tight seal. For example, the packer 126 can be configured to at least partially seal against an interior wall of the wellbore to separate (completely or substantially) a pressure in the well 100 downhole of the packer 126 from a pressure in the well 100 uphole of the packer 126. Although not shown in FIG. 1A, additional components, such as a surface compressor, can be used to boost pressure in the well 100.

The packer 126 is coupled to the first tubing 101 and the second tubing 102. The first tubing 101 permits flow across the packer 126 in a first direction (for example, downhole). The second tubing 102 permits flow across the packer 126 is a second direction (for example, uphole) different from the first direction. Fluid flow across the packer 126 can be restricted to flow through the first tubing 101 in the first direction and flow through the second tubing 102 in the second direction. The first tubing 101 and the second tubing 102 are fluidically isolated from one another. The first tubing 101 and the second tubing 102 can be configured to prevent fluid from flowing directly from the first tubing 101 to the second tubing 102 and directly from the second tubing 102 to the first tubing 101. In some cases, the first tubing 101 and the second tubing 102 are not in physical contact with each other. In some implementations, the first tubing 101 and the second tubing 102 are not concentric. In some implementations, the packer 126 is dual-ported and includes a first port 126*a* and a second port 126*b*. The first tubing 101 can be coupled to the first port 126*a*. The second tubing 102 can be coupled to the second port 126*b*.

The configuration of the first tubing 101 and the second tubing 102 coupled to the packer 126 allows fluid to be injected into the subterranean formation through the first tubing 101 and mix with downhole fluid before being produced to the surface 106 through the second tubing 102. In some cases, the well 100 is a sour gas well that includes sour gas. Sour gas, which can be produced, may cause operational issues (for example, corrode piping and/or downhole equipment), so diluting and/or sweetening the sour gas to reduce the sulfur content (for example, hydrogen sulfide content) downhole before producing the gas to the surface can be beneficial. A dilution stream 104 can be injected into the subterranean formation via the first tubing 101 and mix with downhole fluid (such as sour gas) to dilute the sulfur content of the downhole fluid. The dilution stream can be a gas stream with reduced sulfur content in comparison to the downhole fluid. For example, the dilution stream 104 is sweet gas. The downhole fluid which has been diluted can then be produced to the surface via the second tubing 102. In some implementations, the hydrogen sulfide content of the gas that is produced from the well 100 (after dilution from mixing with the dilution stream) is in a range of from about 1 part per million (ppm) to about 100,000 ppm. For example, the hydrogen sulfide content of the gas that is produced from the well 100 (after dilution from mixing with the dilution stream) is in a range of from about 10 ppm to about 100,000 ppm, from about 100 ppm to about 100,000 ppm, from about 1,000 ppm to about 100,000 ppm, or from about 10,000 ppm to about 100,000 ppm. For example, the hydrogen sulfide content of the gas that is produced from the well 100 (after dilution from mixing with the dilution stream) is less than 10 mole percent (mol. %). For example, the hydrogen sulfide content of the gas that is produced from the well 100 (after dilution from mixing with the dilution stream) is in a range of from about 0.1 mol. % to about 10 mol. %, from about 1 mol. % to about 10 mol. %, from about 2 mol. % to about 10 mol. %, from about 4 mol. % to about 10 mol. %, from about 6 mol. % to about 10 mol. %, from about 8 mol. % to about 10 mol. %, from about 2 mol. % to about 8 mol. %, from about 4 mol. % to about 8 mol. %, from about 6 mol. % to about 8 mol. %, from about 2 mol. % to about 6 mol. %, from about 4 mol. % to about 6 mol. %, from about 2 mol. % to about 4 mol. %, from about 0.1 mol % to about 2 mol. %, or from about 0.1 mol. % to about 1 mol. %. In some implementations, the second tubing 102 includes a valve 103. The valve 103 can be configured to be closed while the dilution stream 104 (such as sweet gas) is flowed through the first tubing 101 to the downhole location (for example, downhole of the packer 126). The valve 103 can be configured to open after the gas with reduced sulfur content has mixed with downhole fluids present in the subterranean formation to form the diluted gas 105, such that the diluted gas 105 can flow through the second tubing 102 and be produced to the surface 106.

Figure 1B:
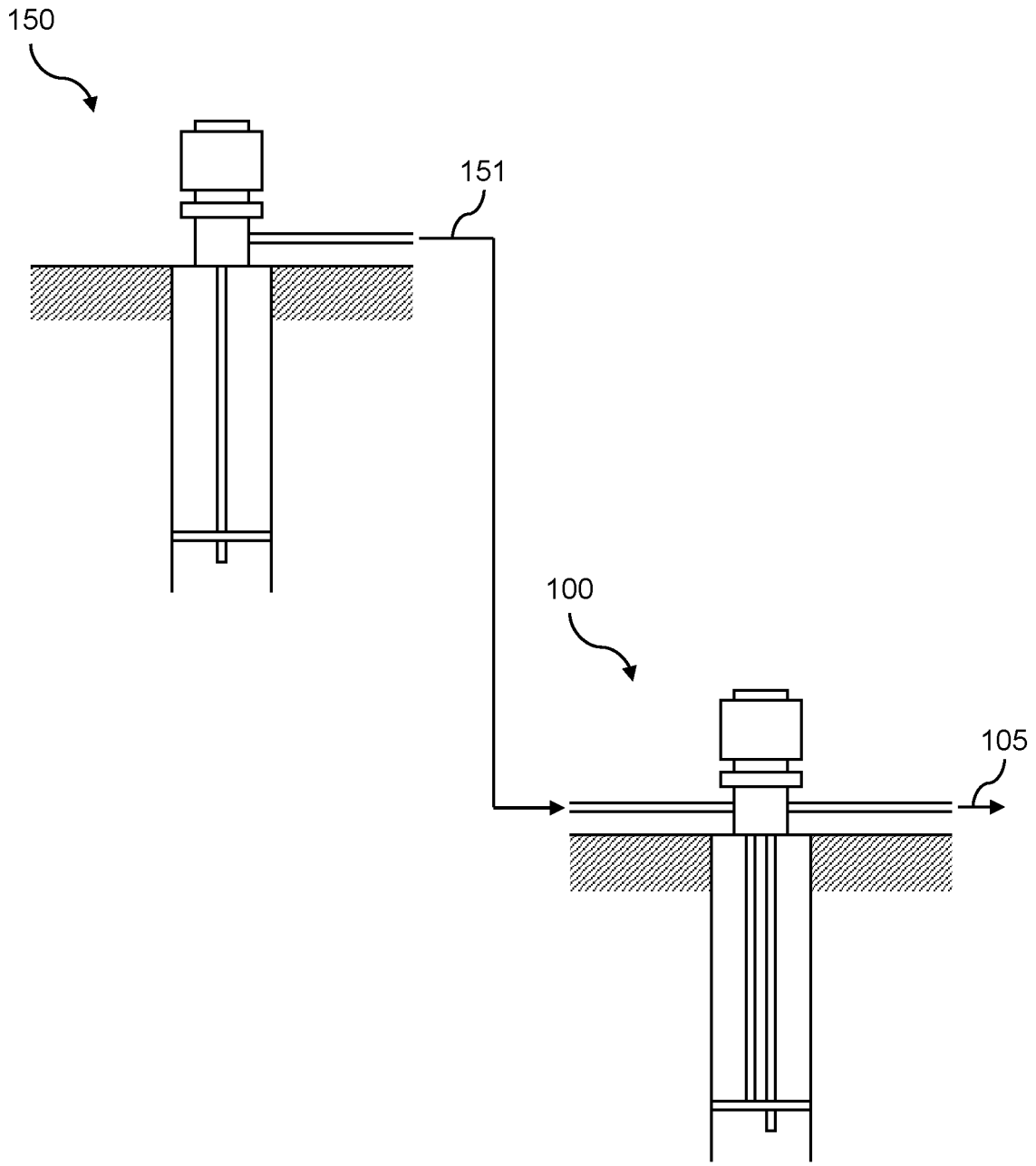
FIG. 1B is a schematic diagram of an example system comprising multiple wells.

FIG. 1B is a schematic diagram of an example system 100B comprising multiple wells. The system 100B includes the well 100 (also shown in FIG. 1A) and an offset well 150 that is located apart from the well 100. As mentioned previously, the well 100 can be a sour gas well. The offset well 150 can be a sweet gas well that produces gas with a reduced sulfur content in comparison to the gas present in the well 100. The sweet gas 151 produced from the offset well 150 can be injected into the well 100 (for example, via the first tubing 101) to dilute the sulfur content of the sour gas present in the well 100. The diluted gas 105 can then be produced from the well 100 (for example, via the second tubing 102).

Figure 1C:
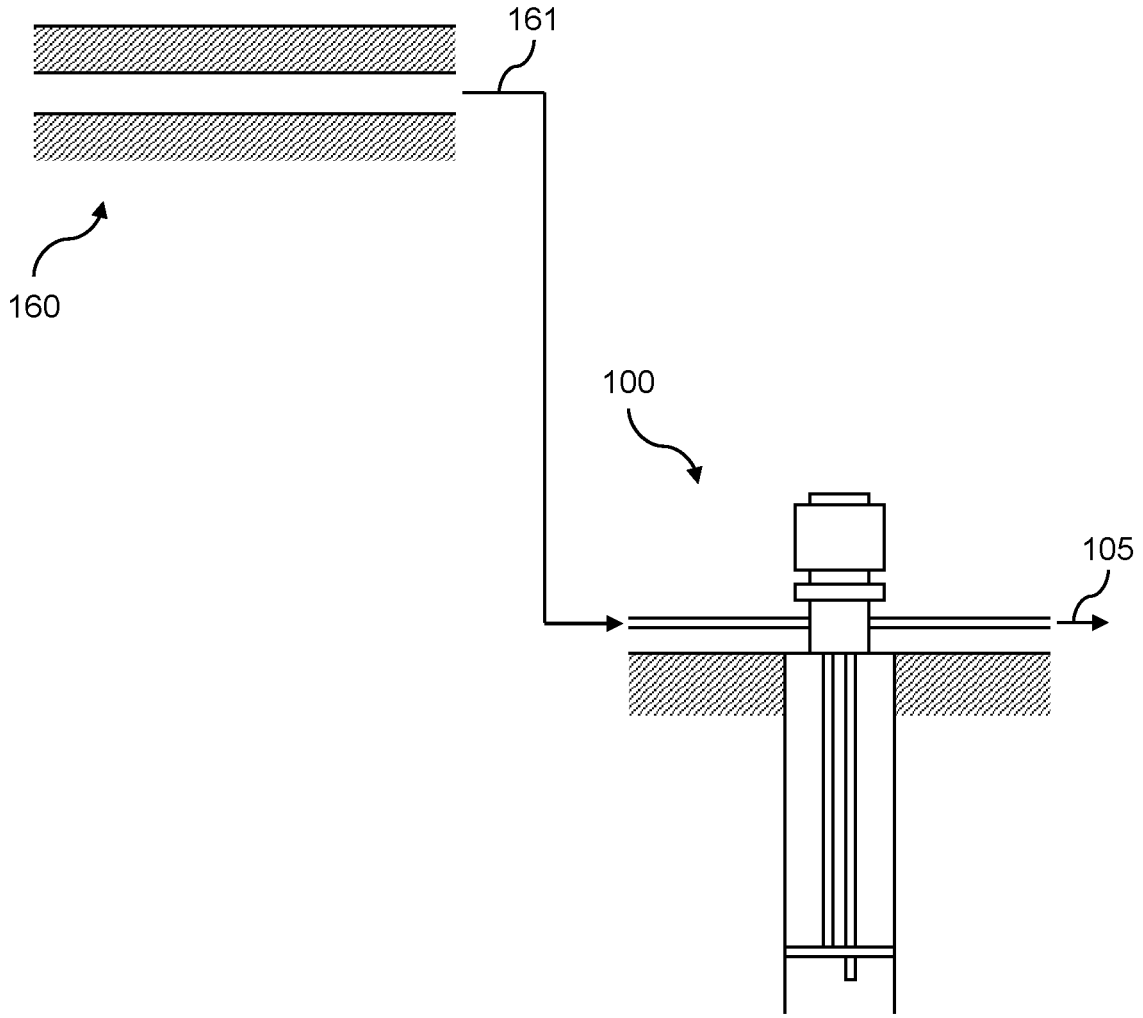
FIG. 1C is a schematic diagram of an example system comprising a well connected to a pipeline.

FIG. 1C is a schematic diagram of an example system 100C comprising the well 100 connected to a pipeline 160. The pipeline 160 can, for example, flow a sweet gas 161 that has a reduced sulfur content in comparison to the gas present in the well 100. At least a portion of the sweet gas 161 flowing through the pipeline 160 can be injected into the well 100 (for example, via the first tubing 101) to dilute the sulfur content of the sour gas present in the well 100. The diluted gas 105 can then be produced from the well 100 (for example, via the second tubing 102). The high operating pressure of the sweet gas 161 flowing through the pipeline 160 can allow for the diluted gas 105 to be produced from the well 100 independent of the use of rotating equipment, such as a compressor or a blower.

Figure 2A:
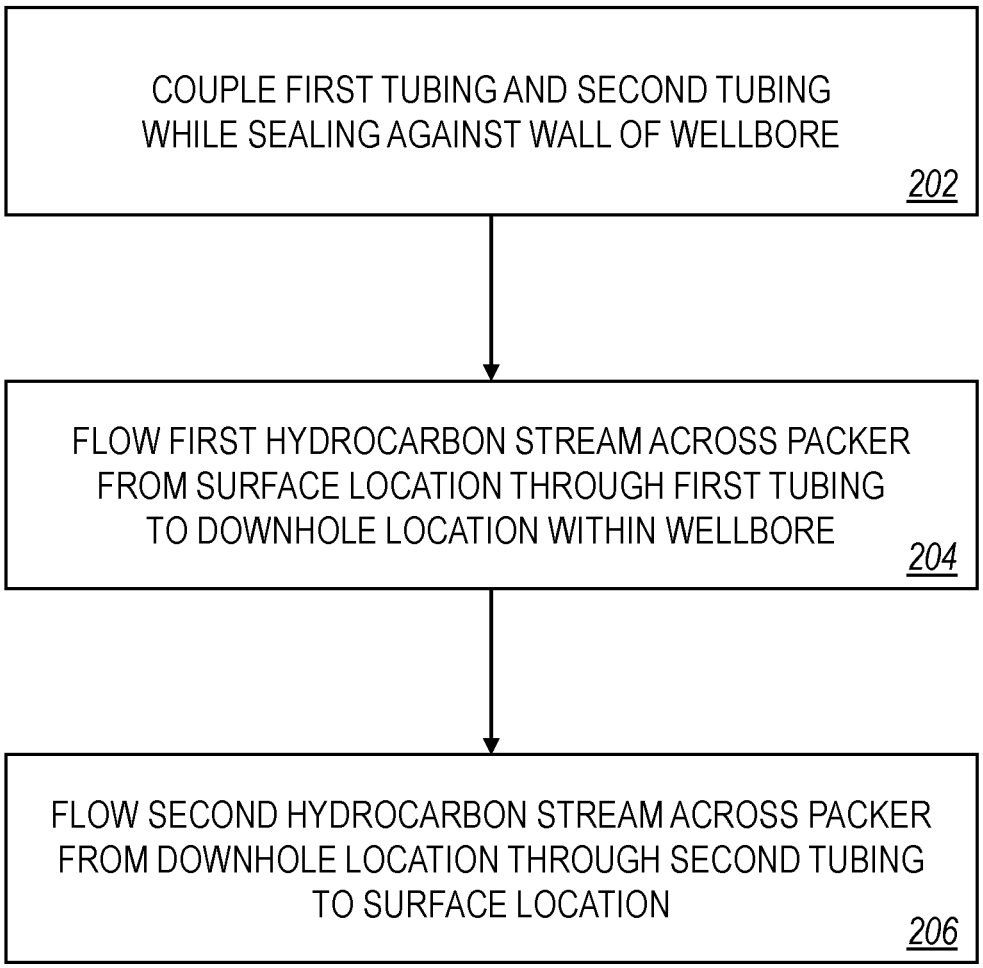
FIG. 2A is a flow chart of an example method for producing gas from a well.

FIG. 2A is a flow chart of an example method 200A for producing gas from a well (such as the well 100). Any of the well 100, system 100B, or system 100C can implement the method 200A. At block 202, a first tubing (such as the first tubing 101) and a second tubing (such as the second tubing 102) are coupled by a packer (such as the packer 126) while the packer seals against a wall of a wellbore formed in a subterranean formation (such as the wellbore wall of the well 100). Fluid flow across the packer 126 in a first direction (for example, in a downhole direction) can be restricted to flowing through the first tubing 101. Fluid flow across the packer in a second direction (for example, in an uphole direction) different from the first direction can be restricted to flowing through the second tubing 102. At block 204, a first hydrocarbon stream is flowed across the packer from a surface location (such as a location at the surface 106) through the first tubing 101 to a downhole location within the wellbore. The first hydrocarbon stream flowed at block 204 can, for example, be a dilution stream that has a sulfur content (for example, hydrogen sulfide concentration) that is less than the sulfur content of downhole fluids already present in the well. In some implementations, the first hydrocarbon stream is flowed at block 204 into the well 100 independent of a compressor or blower. At block 206, a second hydrocarbon stream is flowed across the packer from the downhole location through the second tubing 102 to the surface location. The second hydrocarbon stream is produced from the well 100 at block 206. The second hydrocarbon stream is a diluted and/or sweetened gas stream that has a sulfur content intermediate of that of the downhole fluids (prior to dilution by the dilution stream) and that of the dilution stream. In some implementations, the second hydrocarbon stream is produced from the well 100 at block 206 independent of a compressor or blower. In some implementations, prior to block 202, the method 200A includes drilling, by a drilling rig positioned at the surface 106, into the subterranean formation to form a wellbore and then placing, by the drilling rig, the first tubing 101, the second tubing 102, and the packer 126 within the wellbore. The first tubing 101 and the second tubing 102 can be coupled to the packer 126 as they are lowered by the drilling rig into the wellbore. In some implementations, the method 200A includes producing sweet gas from an offset well (such as the offset well 150) that is located apart from the well 100, and the first hydrocarbon stream flowed into the well 100 at block 204 is the sweet gas produced from the offset well 150 (an example is shown in FIG. 1B). In some implementations, at least a portion of the first hydrocarbon stream flowed into the well 100 at block 204 is sourced from a sweet gas sales pipeline (such as the pipeline 160) (an example is shown in FIG. 1C).

Figure 2B:
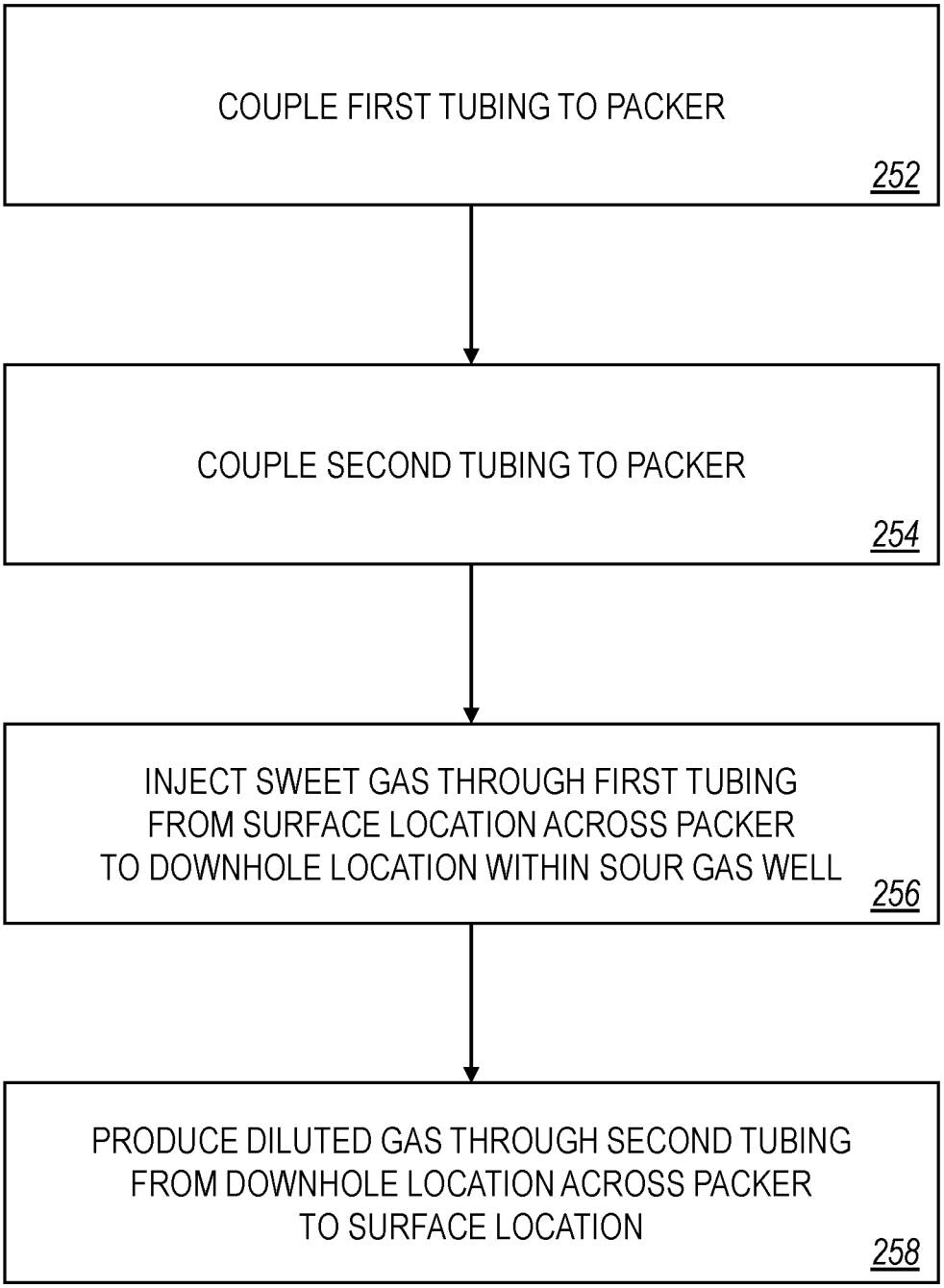
FIG. 2B is a flow chart of an example method for producing gas from a well.

FIG. 2B is a flow chart of an example method 200B for producing gas from a well (such as the well 100). Any of the well 100, system 100B, or system 100C can implement the method 200A. At block 252, a first tubing (such as the first tubing 101) is coupled to a packer (such as the packer 126). The first tubing 101 permits fluid flow across the packer 126 in a first direction (for example, downhole). The packer 126 seals against a wall of a sour gas well (such as the well 100). The sour gas well includes sour gas. At block 254, a second tubing (such as the second tubing 102) is coupled to the packer 126. The second tubing 102 permits fluid flow across the packer 126 in a second direction (for example, uphole) different from the first direction. The second tubing 102 is fluidically isolated from the first tubing 101. At block 256, sweet gas is injected through the first tubing 101 from a surface location (for example, the surface 106) across the packer 126 to a downhole location within the well 100. The sweet gas mixes with the sour gas already present in the well 100 to form a diluted gas. The sweet gas dilutes the sulfur content of the sour gas. In some implementations, the sweet gas is injected into the well 100 at block 256 independent of a compressor or blower. At block 258, the diluted gas is produced through the second tubing 102 from the downhole location across the packer 126 to the surface location. In some implementations, the diluted gas is produced from the well 100 at block 258 independent of a compressor or blower. In some implementations, prior to block 252, the method 200B includes drilling, by a drilling rig positioned at the surface 106, into the subterranean formation to form a wellbore and then placing, by the drilling rig, the first tubing 101, the second tubing 102, and the packer 126 within the wellbore. The first tubing 101 and the second tubing 102 can be coupled to the packer 126 as they are lowered by the drilling rig into the wellbore. In some implementations, the method 200B includes producing sweet gas from an offset well (such as the offset well 150) that is located apart from the well 100, and the sweet gas injected into the well 100 at block 256 is the sweet gas produced from the offset well 150 (an example is shown in FIG. 1B). In some implementations, at least a portion of the sweet gas injected into the well 100 at block 256 is sourced from a sweet gas sales pipeline (such as the pipeline 160) (an example is shown in FIG. 1C).

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any subcombination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

coupling, by a packer, a first tubing and a second tubing while sealing against a wall of a wellbore formed in a subterranean formation, such that fluid flow across the packer in a first direction is restricted to flowing through the first tubing and fluid flow across the packer in a second direction different from the first direction is restricted to flowing through the second tubing;

flowing a first hydrocarbon stream across the packer from a surface location through the first tubing to a downhole location within the wellbore, wherein the first hydrocarbon stream has a hydrogen sulfide content that is less than a hydrogen sulfide content of downhole fluids present in the subterranean formation; and flowing a second hydrocarbon stream across the packer from the downhole location through the second tubing to the surface location, wherein the second hydrocarbon stream has a hydrogen sulfide content that is intermediate of the hydrogen sulfide content of the downhole fluids and the hydrogen sulfide content of the first hydrocarbon stream.

2. The method of claim 1, wherein the first tubing and the second tubing are configured to prevent fluid from flowing from the first tubing to the second tubing and from the second tubing to the first tubing.

3. The method of claim 1, wherein the packer comprises a first port and a second port, the first tubing coupled to the first port, and the second tubing coupled to the second port.

4. The method of claim 1, comprising, prior to flowing the first hydrocarbon stream across the packer from the surface location through the first tubing to the downhole location within the wellbore:

drilling, by a drilling rig positioned at the surface location, into the subterranean formation to form the wellbore in the subterranean formation; and placing, by the drilling rig, the first tubing, the second tubing, and the packer within the wellbore.

5. The method of claim 1, comprising producing sweet gas from a second wellbore, and at least a portion of the first hydrocarbon stream is sourced from the sweet gas from the second wellbore.

6. The method of claim 1, wherein at least a portion of the first hydrocarbon stream is sourced from a sweet gas sales pipeline.

7. The method of claim 6, wherein the second hydrocarbon stream is flowed across the packer from the downhole location through the second tubing to the surface location independent of a compressor.

8. The method of claim 1, wherein the second tubing comprises a valve configured to be closed while the first hydrocarbon stream is flowed through the first tubing to the downhole location and configured to be opened after the first hydrocarbon stream has mixed with downhole fluids present in the subterranean formation to allow the second hydrocarbon stream to flow through the second tubing to the surface location.

9. The method of claim 8, wherein the hydrogen sulfide content of the second hydrocarbon stream is in a range of from 1 part per million (ppm) to 100,000 ppm.

10. A method comprising:

coupling a first tubing to a packer, the first tubing permitting fluid flow across the packer in a first direction, the packer sealing against a wall of a sour gas well, the sour gas well comprising sour gas;

coupling a second tubing to the packer, the second tubing permitting fluid flow across the packer in a second direction different from the first direction, the second tubing fluidically isolated from the first tubing;

injecting sweet gas through the first tubing from a surface location across the packer to a downhole location within the sour gas well, wherein the sweet gas mixes with the sour gas to form a diluted gas; and producing the diluted gas through the second tubing from the downhole location across the packer to the surface location.

11. The method of claim 10, wherein the first tubing and the second tubing are configured to prevent fluid from flowing from the first tubing to the second tubing and from the second tubing to the first tubing.

12. The method of claim 10, wherein:

the packer comprises a first port and a second port;

coupling the first tubing to the packer comprises coupling the first tubing to the first port; and coupling the second tubing to the packer comprises coupling the second tubing to the second port.

13. The method of claim 10, comprising, prior to injecting sweet gas through the first tubing across the packer from the surface location to the downhole location within the sour gas well:

drilling, by a drilling rig positioned at the surface location, into a subterranean formation to form a wellbore of the sour gas well; and placing, by the drilling rig, the first tubing, the second tubing, and the packer within the wellbore.

14. The method of claim 10, comprising producing sweet gas from an offset well located apart from the sour gas well, and the sweet gas produced from the offset well is injected into the sour gas well through the first tubing.

15. The method of claim 10, wherein at least a portion of the sweet gas that is injected into the sour gas well is sourced from a sweet gas sales pipeline.

16. The method of claim 15, wherein the diluted gas is flowed across the packer from the downhole location through the second tubing to the surface location independent of a compressor.

17. The method of claim 10, wherein the second tubing comprises a valve configured to be closed while the sweet gas is flowed through the first tubing to the downhole location and configured to be opened after the sweet gas has mixed with the sour gas to form the diluted gas to allow the diluted gas to flow through the second tubing to the surface location.

18. A system comprising:

a wellbore formed in a subterranean formation comprising a downhole fluid having a first hydrogen sulfide content;

a dilution stream comprising a hydrocarbon, the dilution stream having a second hydrogen sulfide content less than the first hydrogen sulfide content of the downhole fluid;

a first tubing extending from a surface location to a downhole location within the wellbore, the first tubing configured to flow the dilution stream from the surface location into the wellbore, such that the dilution stream mixes with the downhole fluid;

a second tubing extending from the surface location to the downhole location, the second tubing configured to flow a production stream from the wellbore to the surface location, the production stream having a third hydrogen sulfide content that is intermediate of the first hydrogen sulfide content of the downhole fluid and the second hydrogen sulfide content of the dilution stream prior to mixing of the dilution stream and the downhole fluid; and a packer positioned within the wellbore and coupled to the first tubing and to the second tubing, wherein an outer surface of the packer is sealed against a wall of the wellbore, such that fluid flow across the packer in a first direction is restricted to flowing through the first tubing and fluid flow across the packer in a second direction different from the first direction is restricted to flowing through the second tubing.

* * * * *